US006513920B1

(12) United States Patent
Deshmukh et al.

(10) Patent No.: US 6,513,920 B1
(45) Date of Patent: Feb. 4, 2003

(54) CONTROLLING DIFFUSED-AIR BUBBLES IN INK-JET PRINT CARTRIDGES

(75) Inventors: Govind Sanjeevanrao Deshmukh, Corvallis, OR (US); Carey Yliniemi, Monmouth, OR (US); Robert Ronald, Singapore (SG)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/929,718

(22) Filed: Aug. 13, 2001

(51) Int. Cl.[7] ..... B41J 2/19

(52) U.S. Cl. ..... 347/92; 347/93; 347/87

(58) Field of Search ..... 347/84, 85, 86, 347/87, 92–93

(56) References Cited

U.S. PATENT DOCUMENTS

| | | | | |
|---|---|---|---|---|
| 5,671,001 A | | 9/1997 | Elliot et al. | 347/87 |
| 5,886,721 A | * | 3/1999 | Fujii et al. | 347/87 |
| 5,969,739 A | | 10/1999 | Altendorf et al. | 347/87 |
| 6,042,225 A | | 3/2000 | Altendorf et al. | 347/87 |

FOREIGN PATENT DOCUMENTS

| | | |
|---|---|---|
| EP | 0 709 210 | 1/1996 |

* cited by examiner

*Primary Examiner*—Anh T. N. Vo

(57) ABSTRACT

A spacer is incorporated into the standpipe of a foam-ink-containment type of inkjet print cartridge for retarding the growth of a diffused-air bubble in the standpipe, thereby extending the shelf life of the cartridge by ensuring the bubble will not become so large during storage of the cartridge that the bubble occludes flow of ink to the print-head.

21 Claims, 5 Drawing Sheets

CONTROLLING DIFFUSED-AIR BUBBLES IN INK-JET PRINT CARTRIDGES

TECHNICAL FIELD

This invention relates to the control of diffused-air bubbles in ink-jet print cartridges for the purpose of ensuring acceptable operation of the cartridge irrespective of whether the cartridge is stored for a significant period of time prior to use of the cartridge.

BACKGROUND OF THE INVENTION

An ink-jet printer typically includes one or more cartridges that contain ink. In some designs, the cartridge houses separate reservoirs of more than one color of ink. Each reservoir is in fluid communication with a printhead that is mounted to the body of the cartridge.

The printhead is controlled for ejecting minute drops of ink though orifices on the printhead to a printing medium, such as paper, that is advanced through the printer. The cartridge is usually scanned across the width of the paper while the printhead ejects a swath of ink droplets onto the paper. The paper is advanced between scans. The ejection of the drops is controlled so that the swaths of printed ink combine to form recognizable images on the paper.

Although the printhead is a reliable and efficient means for ejecting ink droplets, it carries no mechanism for preventing leakage of ink through the orifices when the printhead is not operating. Therefore, ink supplied to the printhead is contained under a slight partial vacuum or back pressure. The back pressure is large enough to prevent the free flow of ink from the printhead, but not so large as to prevent an activated printhead from expelling ink. This range can be considered the printhead's back pressure operating range.

Some types of ink-jet cartridges use porous material such as synthetic foam to contain the ink within the reservoir. The foam is nearly completely saturated with ink. Unsaturated portions of the foam provide the capillarity for holding the ink in the reservoir in the desired back pressure operating range.

The ink reservoir of such a cartridge includes a chamber for storing the foam. The reservoir also includes a standpipe into which the ink flows from the chamber. No foam is in the standpipe. Ink stored in the standpipe flows through a feed slot that is continuous with but relatively smaller than the standpipe. The feed slot thus connects between the standpipe and printhead to deliver the ink to the printhead.

A fine-mesh filter is mounted to the standpipe at the junction of the foam and the standpipe. The filter prevents any solid debris or large air bubbles from moving into the standpipe. The foam is compressed against the filter-covered end of the standpipe. The standpipe protrudes somewhat into the ink chamber, so that the foam compression against the filter is localized there to create a relatively high capillarity in the region of the foam nearest the filter. This high capillarity ensures that ink stored in the foam near the filter will be drawn to and through the filter, and that a liquid (ink) seal will be maintained at the filter until all of the useable ink in the foam is delivered into the standpipe.

The print cartridge filling process may leave some residual amounts of air in both the foam and the standpipe. Also, a certain amount of air is dissolved in liquid ink, which is typically water based. Some of this dissolved air will leave solution and collect as bubbles in the foam and the standpipe. Air that collects in the foam can be vented to ambient. To this end, some of the walls that define the ink chambers may be configured to provide a series of connected relief pockets adjacent to the foam. As explained in U.S. Pat. No. 5,671, 001, which is assigned to the assignee of the present application, such pockets provide a practical means for removing air bubbles trapped in the foam, which bubbles might otherwise expand (especially when the cartridge is subjected to external temperature and pressure variations) by an amount sufficient to force ink to leak from the printhead orifices.

A small air bubble that is normally present in the standpipe after the cartridge is filled does not affect the operation of the print cartridge. That is, the bubble is not large enough (relative to the volume of the standpipe) to occlude ink flow through the standpipe. Such occlusion would cause the printhead to fail in a manner analogous to a pump that loses its priming liquid. Thus, this type of printhead failure is often referred to as "de-priming."

Over time, the air bubble in the standpipe may grow. Minute amounts of air will diffuse from the atmosphere through the foam containment and filter and into the standpipe. The air coalesces with any residual air in the standpipe to form what can be characterized as a diffused-air bubble.

The growth of the diffused-air bubble in a standpipe can affect the shelf life of a print cartridge. Under certain conditions the diffused-air bubble in a stored print cartridge can eventually grow to a size that occludes ink flow to the printhead and cause the printhead to de-prime shortly after the cartridge is installed and used.

SUMMARY OF THE INVENTION

The present invention is directed to a method and apparatus for controlling the growth of diffused-air bubbles in ink-jet print cartridges for the purpose of ensuring a satisfactorily long shelf life of the print cartridge.

Embodiments of the present invention provide a method of retarding in time the growth of a diffused-air within the standpipe. This delays the occurrence of a diffused-air bubble that is large enough to occlude ink flow to the printhead, thereby extending the shelf life of a print cartridge.

As one aspect of the invention, there is provided a mechanism for increasing the distance (hence, the time) that diffusing air must travel before reaching a location in the standpipe where it can coalesce into a diffused-air bubble. A spacer is mounted in the standpipe to accomplish this in one preferred embodiment of the invention.

Apparatus and methods for carrying out the invention are described in detail below. Other advantages and features of the present invention will become clear upon review of the following portions of this specification as well as the drawings.

DETAILED DESCRIPTION OF PREFERRED EMBODIMENTS

Figure 1:
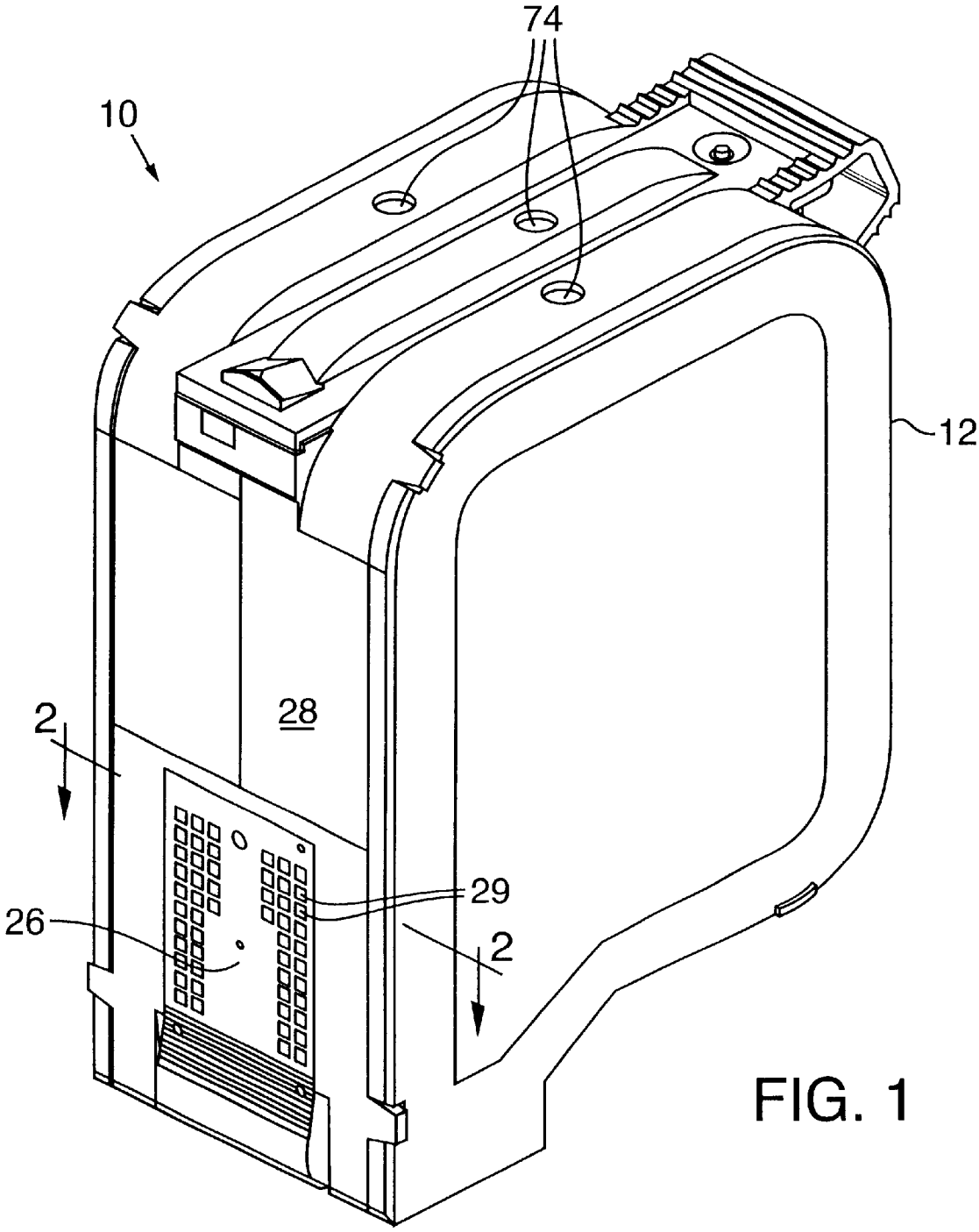
FIG. 1 is a perspective view of an ink-jet print cartridge with which the present invention may be used.

FIG. 1 illustrates an exemplary ink-jet print cartridge 10 that includes a plastic body 12 that houses reservoirs for ink. This exemplary print cartridge contains three colors of ink: cyan, yellow, and magenta. Each color is contained in a separate ink reservoir in the print cartridge.

A printhead 14 (FIG. 2) is mounted to the bottom wall 16 of the cartridge body 12 and includes three groups of orifices 18, 20, 22 and their associated ink firing chambers and heater resistors that are carried on a printhead substrate 24.

A thin circuit 26 (FIG. 1) is attached to the body 12 of the cartridge, partly on a front side 28 of the cartridge. The circuit extends from that side 28 and bends to extend across the bottom wall 16 of the cartridge so that electrically conductive traces of the circuit connect with contact pads (not shown) in the printhead 14 that are near the edges of the printhead. The other ends of the traces on the circuit 26 terminate in contact pads 29 (FIG. 1), which pads mate with corresponding pads on a printer carriage (not shown). The circuit 26 carries control signals from a microprocessor-based printer controller to the individual heater resistors in the printhead 14 that produce the ink drop ejections through the orifices of the printhead.

Figure 2:
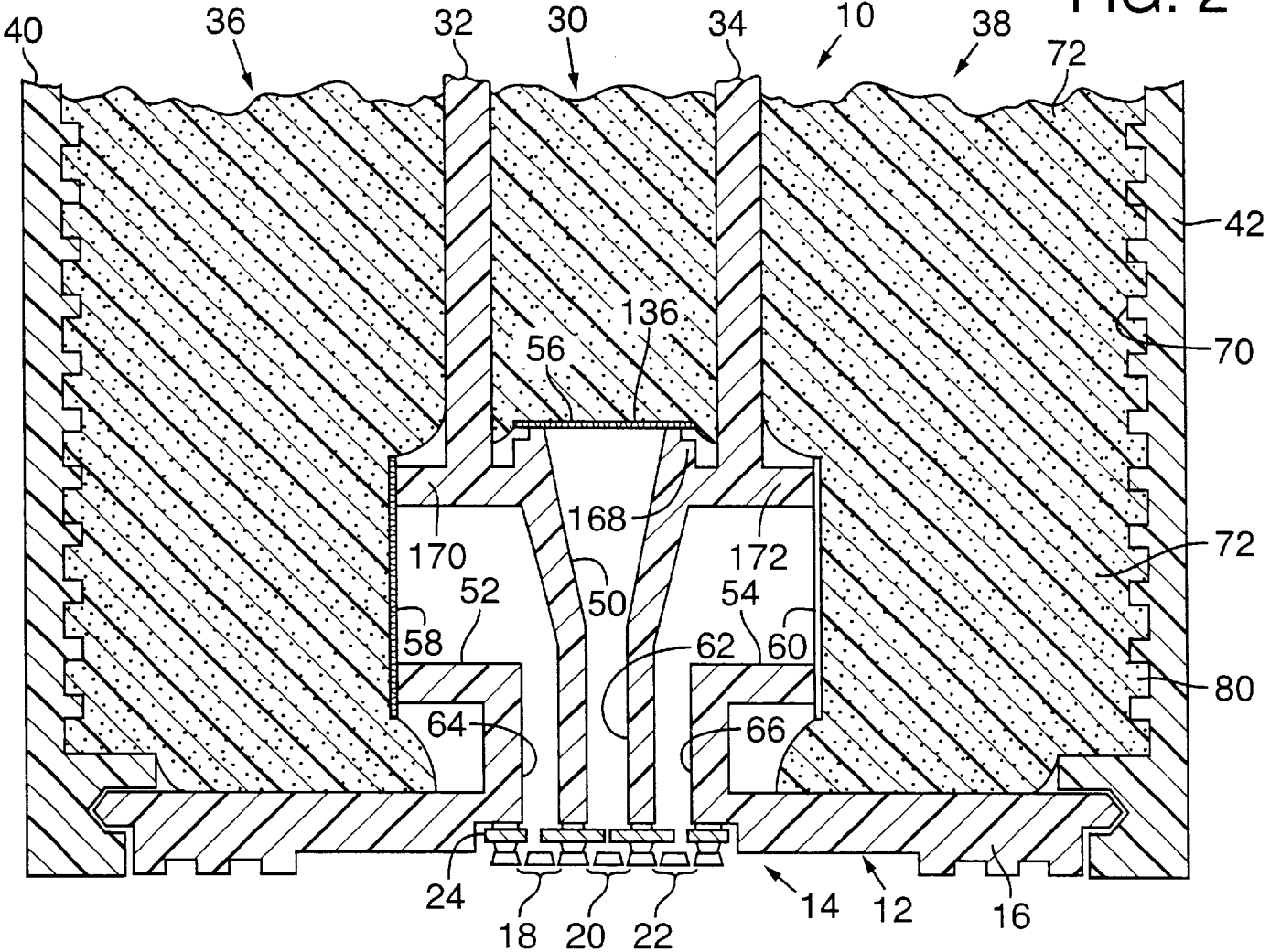
FIG. 2 is an enlarged, partial cross sectional view of the cartridge, taken along line 2—2 of FIG. 1.

Walls of the printhead body 12 define the three ink reservoirs mentioned above. As seen in FIG. 2, a central reservoir 30 is located between two internal walls 32, 34 that extend between the front side 28 and an opposing back side of the cartridge body 12. One side reservoir 36 is defined between the internal wall 32 and a corresponding sidewall 40. Similarly, the other side reservoir 38 is defined between the internal wall 34 and opposite sidewall 42. Each sidewall 40, 42 is ultrasonically bonded to the remaining portion of the cartridge body 12. That remaining portion is preferably a single piece that is formed by an injection molding process.

As shown in FIG. 2, the cartridge body defines a manifold structure in the vicinity where the printhead 14 is mounted to the bottom wall 16 of the print cartridge body 12. This structure includes three standpipes 50, 52, 54, each one having an inner end that is in fluid communication with an associated one of the ink reservoirs 30, 36, 38. Each standpipe is generally rectangular in cross section and carries at its inner end a fine-mesh filter 56, 58, 60 that is heat staked to the standpipe. The filter may be, for example, a stainless steel wire mesh having a nominal filtration capability of about 15 microns and a thickness of about 0.15 mm.

Each standpipe connects with a feed slot 62, 64, 66 that is defined in the cartridge body to conduct ink from the connected standpipe to a corresponding slot in the printhead substrate 24, thereby to supply ink to the individual heater resistors of a particular orifice group 18, 20, 22.

The filter-carrying inner end of each standpipe 50, 52, 54 protrudes somewhat into the associated reservoir volume. There, the filter 56, 58, 60 is in compressive contact with foam that fills the reservoir between the filter and the top of the print cartridge. This foam-filled portion of the reservoir can be referred to as the ink chamber for storing the bulk of the ink of a particular color.

For example, the right-side ink chamber 70 is filled with foam 72. The foam is preferably a polyether-based polyurethane open cell foam without anti-oxidant. The foam is felted to about 18% of its pre-felted volume via the application of heat and pressure. After the foam 72 is inserted into the chamber 70, the above mentioned cartridge sidewall 42 is ultrasonically bonded to the cartridge body to enclose the foam 72 within the cartridge. Thereafter, ink is injected into the foam 72 through an opening 74 in the top of the cartridge (FIG. 1). That opening is afterward covered with a specially designed vent plug that provides a serpentine path for communication between ambient air and an air space above the foam 72. Thus, the air surrounding the foam remains at ambient pressure despite pressure changes that may occur inside or outside of the cartridge.

It is noted that the other ink reservoirs are similarly filled with foam and ink and vented as just described with respect to chamber 70. Moreover, it will be understood that other porous material may be used in lieu of foam, such as innately reticulate thermoset melamine condensate.

The interior surface of both of the cartridge sidewalls 40, 42 are provided with a number of relief pockets 80 and connected channels that generally conform to those described in U.S. Pat. No. 5,671,001, hereby incorporated by reference. As noted, the pockets 80 and channels provide a practical means for removing air bubbles trapped in the foam, which might otherwise expand (especially when the cartridge is subjected to temperature and pressure variations) by an amount sufficient to force ink to leak from the printhead orifices.

Figure 3:
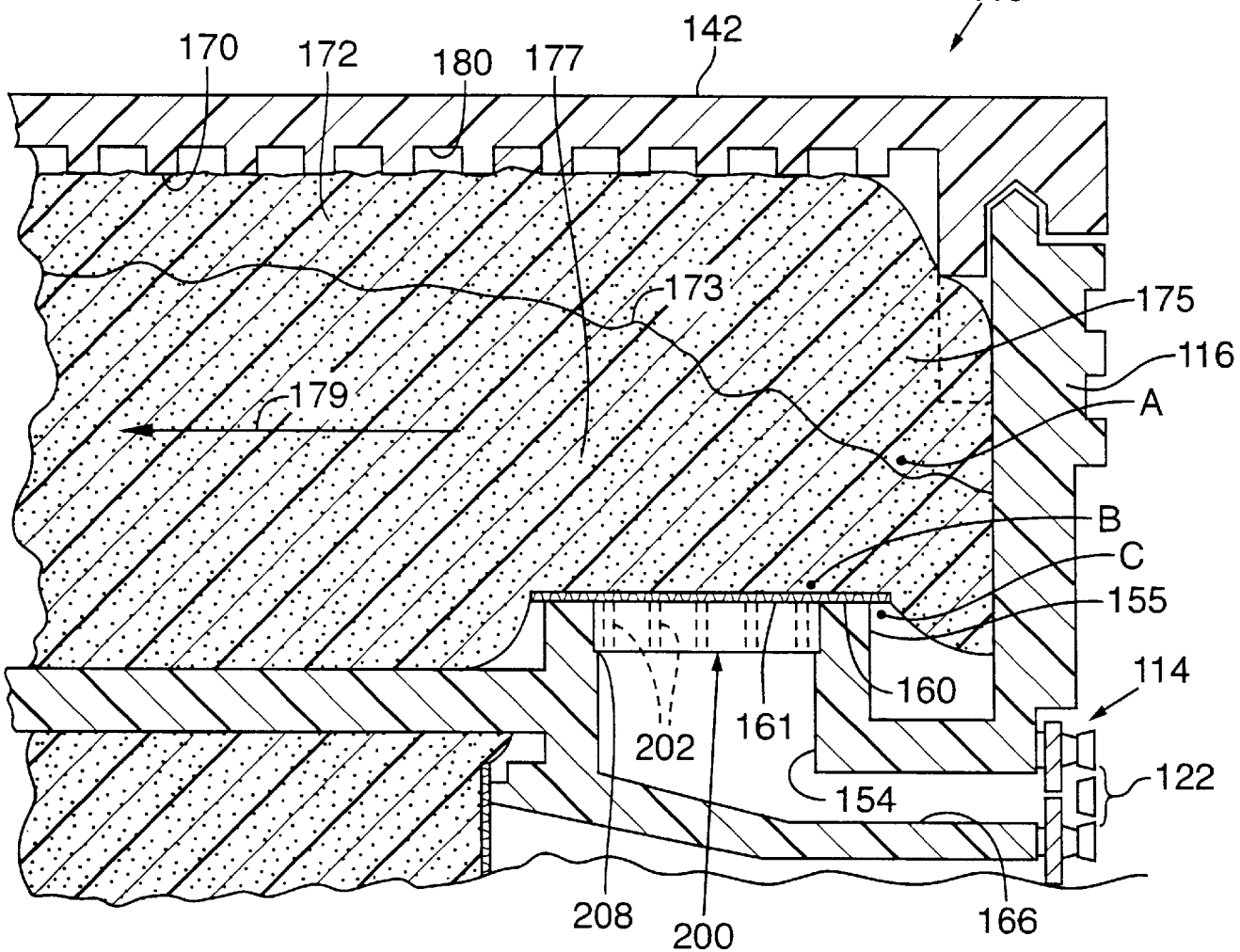
FIG. 3 is an enlarged cross sectional view of a print cartridge like that of FIGS. 1 and 2 but modified into a preferred embodiment of the present invention for controlling the growth of diffused-air bubbles within the standpipe of the cartridge.

FIG. 3 depicts in enlarged cross section a portion of an exemplary ink-jet cartridge 110 that, for the most part, matches the cartridge 10 described above, except for modifications over what is depicted in FIG. 2 for the purpose of incorporating the features of the present invention. Those features are described more below. First it is noted that, unless stated otherwise, the following components of the embodiment shown in FIG. 3 match the description earlier given for correspondingly identified components. For instance, sidewall 142 matches sidewall 42. Other matching components are: pockets 180 and 80; bottom walls 116 and 16; printheads 114 and 14; standpipes 154 and 54; filters 160 and 60; chambers 170 and 70; and foam 172 and 72.

The cartridge 110 illustrated in FIG. 3 is shown in an orientation such as it might be placed while it is stored, after it has been filled with ink, but before it is installed in a printer. In short, the cartridge is placed on its side so that a side ink chamber (here, for example, the right-side chamber 170) is facing up. In such an orientation, the filter 160 is in a horizontal plane with the foam 172 compressed against the upper surface of the filter. The standpipe 154 extends below the filter 160 and joins and ink slot 166 that feeds ink to an orifice group 122 of the printhead 114.

As noted above, the relief pockets 180 provide a path for ambient air adjacent to the foam to prevent ink leakage through the printhead. As a consequence, the foam 172 includes a partly saturated or "damp" zone 175, which is illustrated in FIG. 3 as the portion of the foam 172 above the imaginary line 173. This damp zone 175 is unsaturated relative to the ink-saturated zone 177, which can be considered the region of the foam underlying the line 173. The saturated zone is about 95%–100% saturated with ink adjacent to the filter and diminishing somewhat in the direction toward the damp zone 175. The damp zone has continuously diminishing saturation in the direction toward the outer edges of the foam 172. Air fills the pores in the damp zone foam that are not filled with ink.

In short, even though the foam 172 is saturated with ink in the vicinity of the filter 160, air is near the filter.

Moreover, when the cartridge is stored as shown in FIG. 3, there may be several short paths for air in the chamber 170 to move slowly (by diffusion) through the filter 160 and coalesce as a growing bubble against the underside 161 of the filter, directly in the path of ink flowing through the filter to the printhead.

For instance, air in the damp zone 175 located at "A" in FIG. 3 has a relatively short distance to move until it is adjacent to the screen 160 at point "B" in FIG. 3.

Also, one can expect air to be present alongside the outer surface 155 of the protruding portion of the standpipe 154, such as shown at point "C," within voids in the chamber 170 where the compressed foam does not reach. It will be appreciated that the path for this air to diffuse from points "B" and "C" to the underside 161 of the filter 160 inside the standpipe (ignoring, for the moment, the presence of the below-described spacer 200) can be relatively short. Also, in the event that the staking of the filter 160 to the standpipe 154 is incomplete (leaving gaps), the path from "C" to the underside 161 of the filter within the standpipe is even shorter since air could move through the gaps rather than the foam.

As noted, any air that diffuses into the standpipe 154 coalesces in the standpipe, with any residual air from the cartridge filling process, as a diffused-air bubble. If that bubble were to grow over time to about 85% of the standpipe volume, the ink flow to the ink slot 166 would be effectively occluded, leading to a de-priming failure of the printhead.

It is noteworthy here that other factors may tend to increase the rate of diffusion of air along the just described exemplary short paths to and through the filter 160. For example, the configuration of the side chamber 170 may be such that the foam 172 within the chamber is slightly more compressed at the top of the cartridge than at the bottom. This produces increased capillarity in the direction of arrow 179 in FIG. 3. This effect, as well as the use of relatively low-viscosity inks (in the range of 1.5 centipoise, low viscosity fluids have higher diffusivities, thus they are easier for air to diffuse through and result in faster air accumulation in the standpipe) can cause some of the stored ink to migrate gradually through the foam in the direction of the capillarity gradient (that is, the direction of arrow 179). This migration is further facilitated by the sideways orientation of the stored cartridge (FIG. 3) because the capillarity gradient is not otherwise balanced by the effect of gravity, as it would be when the cartridge is installed or otherwise in an upright, printhead-down position. The ink that migrates from the vicinity of the filter 160 is replaced by air that diffuses toward and through the filter.

Irrespective of the particular mechanism by which air diffusion causes a growing air bubble inside the standpipe and adjacent to the underside of the filter, the present invention incorporates a spacer 200 within the standpipe 154 for significantly delaying the growth of such a bubble, thereby to lengthen the period of time the cartridge may be stored on its side and still be operable after being installed in the printer.

The spacer 200 essentially retards or delays the growth of the diffused-air bubble within the standpipe, thereby delaying the occurrence of a diffused-air bubble that is large enough to occlude ink flow to the printhead. In one embodiment, the spacer 200 increases the distance (hence, the time) that diffusing air must travel before that air reaches a location in the standpipe where it can coalesce into a diffused-air bubble large enough to occlude ink flow.

Figure 4:
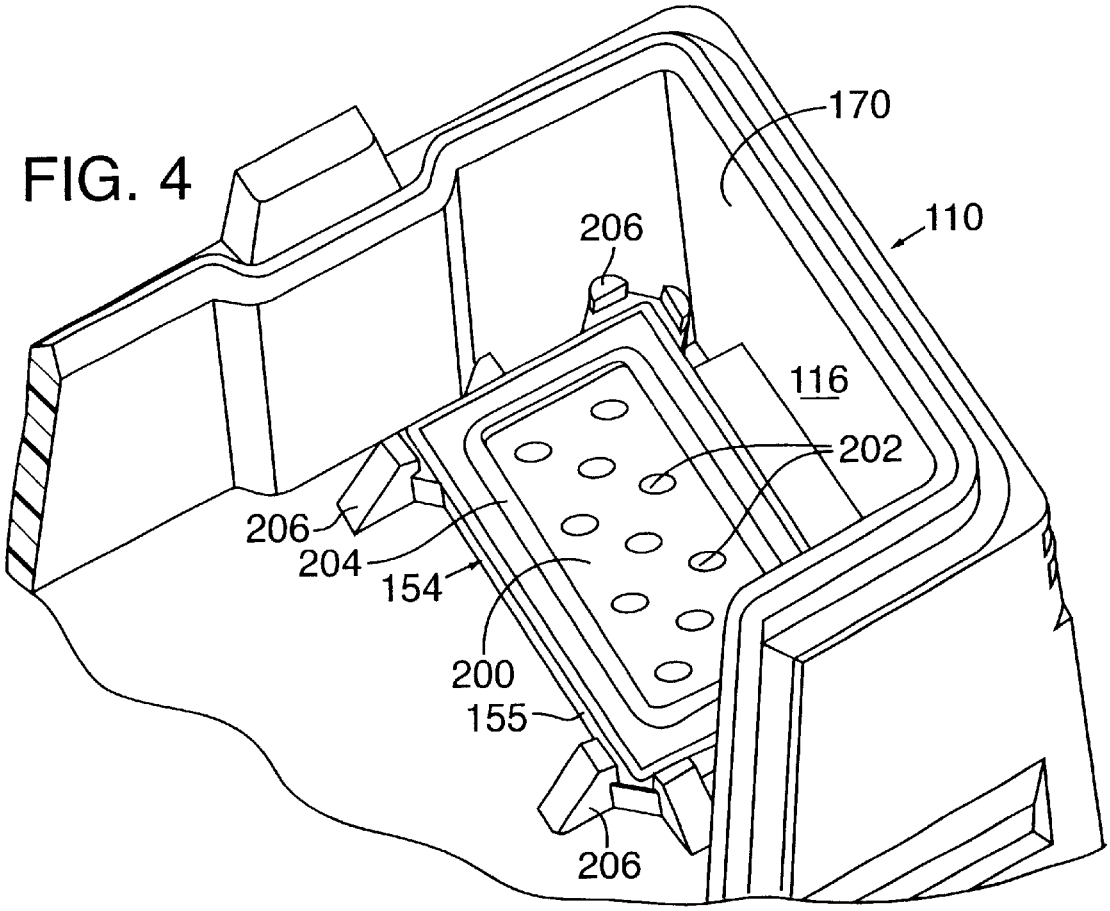
FIG. 4 is an enlarged, partial perspective view of the spacer component of the present invention.

With reference to FIGS. 3 and 4, the spacer 200 comprises a solid member having conduits 202 formed through it. The spacer material may be formed of a thermoplastic such as that sold under the trademark DELRIN by DuPont & Co. of Wilmington Del. The spacer 200 is press fit into the inner end of the standpipe 154 adjacent to the filter 160. FIG. 4 shows the spacer 200 inserted in the standpipe 154, but before a filter is heat-staked over the spacer. In this regard, the view of FIG. 4 shows a ring 204 of the cartridge body material formed on the inner end of the standpipe 154 and upon which the rectangular filter 160 is to be placed. This FIG. 4 represents the unassembled cartridge, before the filter is attached and the chamber 170 is filled with foam and closed with a sidewall. The filter position is properly aligned, prior to heat-staking, by registration features 206 molded into the cartridge body.

Heat and pressure applied to the filter cause the ring 204 to flow and securely stake the filter to the standpipe opening as shown in FIG. 3. FIG. 3 also illustrates shoulders 208 formed around the standpipe 154 for securing the filter against movement further into the standpipe volume. The filter 160 thus overlays the upper or inlet side of the spacer 200. Preferably, the filter 160 contacts the spacer 200 or is spaced no more than about the filter thickness from the surface of the spacer.

The area of the spacer surface between the shoulders 208 matches the filter area that covers the standpipe 154. Therefore, any ink or air that flows through the filter 160 must flow through the conduits 202 of the spacer 200.

Since air that diffuses through the filter 160 must pass through the spacer conduits 202 before reaching a location in the standpipe where the air can coalesce as a diffused-air bubble, the amount of time the print cartridge can be stored on its side is increased (relative to the storage time of a cartridge without the spacer) by the amount of time required for the air to diffuse through the spacer. Thus, the thickness of the spacer 200, as measured vertically in FIG. 3 between the opposing surfaces of the spacer, is one control parameter for retarding the growth of the diffused-air bubble. Also, as best viewed in (FIG. 4), the conduits 202 are spaced from the edges of the spacer, thereby to lengthen by that spacing the horizontal distance (FIG. 3) for air to move, for example, from point "C" to enter a conduit. Thus, this distance is another diffusion-path control parameter.

Put another way, the spacer thickness and strategically spaced conduits define a flow path length to and through the spacer 200. In one embodiment, and under favorable conditions (such as relatively high-viscosity ink, and low temperature storage of the cartridge), a flow path length that is slightly greater than the filter thickness will suffice for sufficiently delaying the growth of the bubble.

In another embodiment, and assuming relatively low viscosity ink and the possibility of higher temperature storage (both of which increase the rate of air diffusion) the spacer thickness (flow path lengths) is preferably greater than 1.0 mm and most preferably about 1.6 mm. At this latter thickness, and assuming a standpipe volume of about 2.0 cc, the cartridge 110 may be stored on its side for at least 18 months without developing a failure-producing diffused-air bubble. In any event, it is contemplated that once the advantage of delaying the growth of a diffused-air bubble is understood, one can, without undue experimentation, configure a spacer component as needed to work with any size standpipe, ink viscosity, etc.

The conduits 202 of the spacer 200 each define discrete, straight paths through the body of the spacer. In a preferred embodiment, the conduits are arranged in a regular array (see FIG. 4) and sized to have a diameter of about 0.75 mm.

It will be appreciated that any of a variety of conduit configurations will suffice, however.

A useful design consideration for configuring the conduits is to ensure that the ink flow through the standpipe is substantially laminar. Another design consideration is to break the air entry points from one contiguous line to multiple entry points at varied horizontal distances to increase diffusion paths. This is accomplished in part by the uniform distribution of conduits 202 as shown in the embodiment of FIG. 4. Also, it is preferred that the aggregate flow area of the conduits (that is, the sum of the cross section or flow areas of the conduits) match the flow area of the ink feed slot 166 to which the standpipe is connected.

Figure 5:
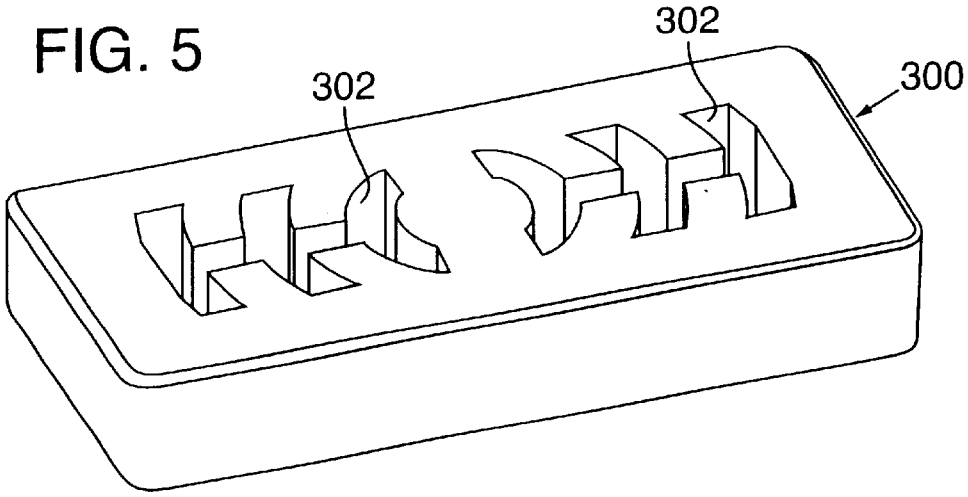
FIG. 5 is a perspective view of another embodiment of the spacer component.

The conduits 202 of the spacer can be shaped in a manner other than the cylindrical ones illustrated in FIG. 4. For example, FIG. 5 depicts a spacer 300 having two, mirror-image conduits 302, each conduit featuring three, spaced-apart, arced slits joined by a straight connector slit. It is also contemplated that a single conduit would suffice, provided that is sufficiently narrow (such as a helical-shaped slit) to prevent movement of large air bubbles through it.

Although the foregoing discussion about the spacer 200 has been limited to one of the two side standpipes of the cartridge, it is preferred that a spacer be incorporated into both side standpipes so that the shelf-life enhancing effects of the spacer will be had irrespective of which side of the cartridge faces upwardly during storage.

Figure 6:
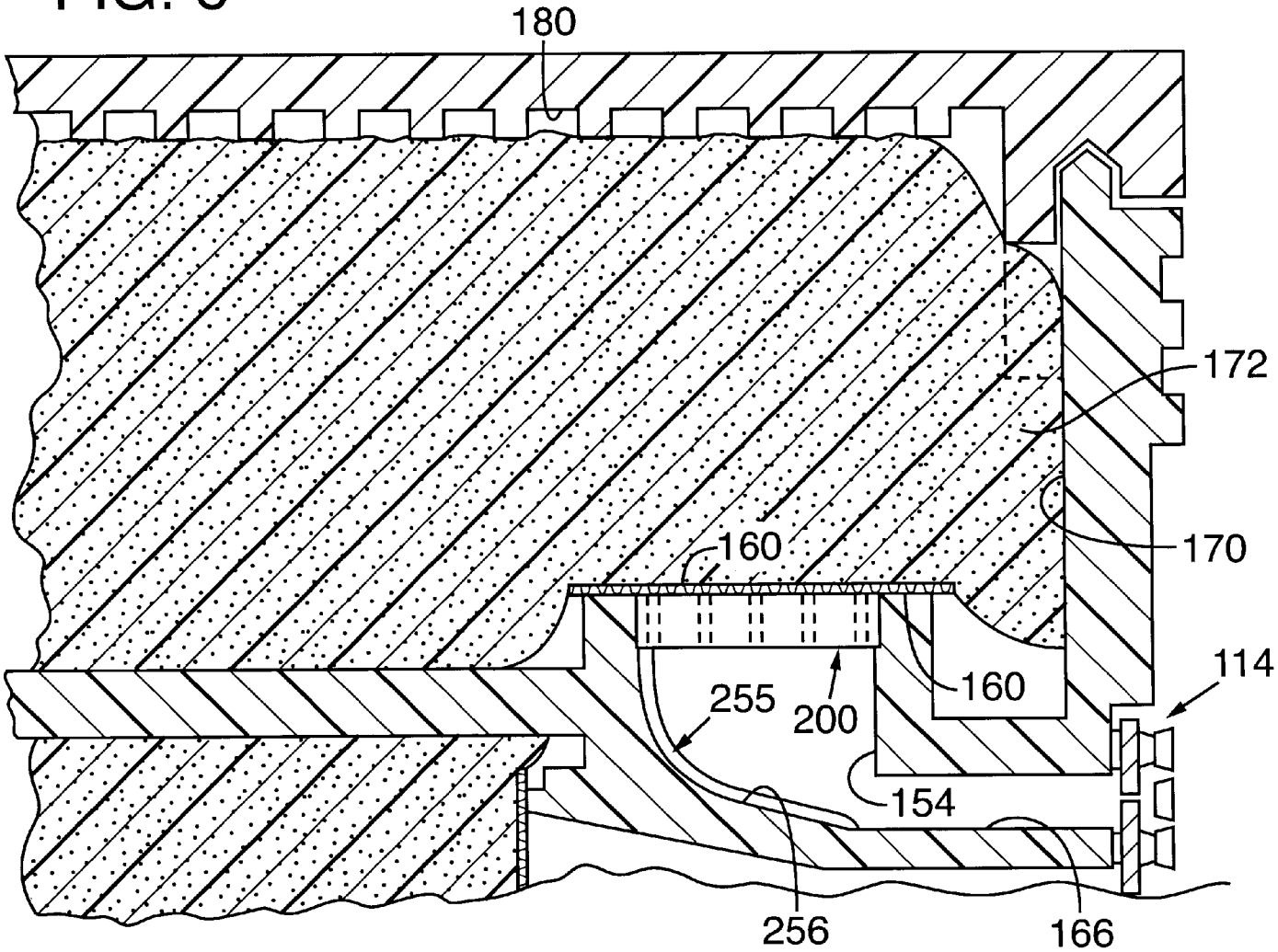
FIG. 6 is an enlarged cross sectional view like FIG. 3 but showing another alternative embodiment of the present invention.

The embodiment of the invention shown in FIG. 6 is substantially identical to that of FIG. 3, but for the use of additional measures to forestall the occluding effect of a diffused-air bubble within the standpipe 154. In particular, one internal surface 255 of the rectangular-cross-section standpipe is curved as shown in the cross section of FIG. 6. A number of evenly spaced capillary grooves 256 are made into this curved surface 255. The grooves 256 are about 0.2 mm wide and deep. Thus, liquid ink can flow through the grooves 256 and the grooves are unlikely to be occluded by a sizable diffused-air bubble as compared to a smooth-walled version of the standpipe. Nonetheless, the present invention contemplates that the grooved standpipe surface 255 be used in conjunction with the above-described spacer 200 in order to achieve the extended shelf life described above.

Having here described preferred embodiments of the present invention, it is anticipated that individuals skilled in the art may make other modifications thereto within the scope of the invention. The spirit and scope of the invention is not limited to those embodiments, but extend to the various modifications and equivalents of the invention defined in the appended claims.

What is claimed is:

1. An ink-jet print cartridge, including:

an ink reservoir including a pipe member having an opening;

a printhead;

a filter mounted in the reservoir to cover the pipe member opening and having first and second opposing sides and a thickness between those sides;

a porous member covering the first side of the filter and located so that the filter is between the porous member and the printhead; and a spacer located adjacent to and underlying all of the second side of the filter and configured to define a path for ink flow from the filter toward the printhead.

2. The cartridge of claim 1 wherein the spacer includes an inlet side that is adjacent to the second side of the filter, and an opposing side, the spacer being sized so that the distance between the inlet side and opposing side defines a flow path length, the flow path length being greater than the filter thickness.

3. The cartridge of claim 2 wherein the flow path length is at least 1.0 mm.

4. The cartridge of claim 3 wherein the flow path length is about 1.6 mm.

5. The cartridge of claim 1 wherein the spacer is a solid member but for an array of conduits formed therethrough for defining a plurality of discrete ink flow paths.

6. The cartridge of claim 5 wherein the filter has an area through which ink may flow and wherein the spacer has an area that substantially conforms to the area of the filter so that ink that flows though the filter is directed through the conduits in the spacer.

7. The cartridge of claim 1 wherein the pipe member includes a grooved internal surface.

8. A method for conducting ink through a standpipe that is located between a filter and a printhead of an ink-jet printhead cartridge wherein the filter has a porous member compressed against one side thereof, the method comprising conducting all of the ink that flows to the printhead through the filter and though a plurality of discrete conduits from the filter toward the printhead.

9. The method of claim 8 including the step of locating the plurality of discrete conduits adjacent to the filter.

10. The method of claim 8 wherein the standpipe joins a slot that delivers ink from the standpipe to the printhead, the slot having a cross sectional area, the method including the step of sizing die conduits to have flow areas through which the ink is conducted, the conduit flow areas summing to substantially match the cross sectional area of the slot.

11. The method of claim 8 including the step of grooving part of the standpipe.

12. A method of controlling the growth of an air bubble within the standpipe of an ink-jet print cartridge, wherein the standpipe is between a filter and a printhead in the cartridge, and wherein over time an air bubble can grow to an occluding size that is sufficient for occluding ink flow to the printhead thereby causing the printhead to fail the method comprising the step of retarding for a predetermined period of at least 18 months the growth of an air bubble to an occluding size within the standpipe.

13. The method of claim 12 wherein the retarding step includes configuring the standpipe to have a region where an air bubble is unable to grow to the occluding size.

14. The method of claim 13 including the step of locating the region adjacent to the filter.

15. The method of claim 12 wherein a porous member is located against one side of the filter and wherein the method includes locating the region on the side of the filter that is opposite the porous member.

16. A spacer assembly for a standpipe of an ink-jet print cartridge that has a foam filled ink reservoir, comprising a solid body having at least one conduit therethrough and being shaped for insertion into the standpipe so that any ink that flows though the standpipe will flow through the at least one conduit in the spacer; and a filter mounted in the reservoir adjacent to the spacer and with the foam compressed against one side of the filter.

17. The spacer of claim 16 wherein the body has a thickness corresponding to the length of the conduits, the thickness being at least 1.0 mm.

18. The spacer of claim 16 including a plurality of conduits in the body and wherein the conduits are disposed in a substantially uniformly distributed array.

19. An ink-jet print cartridge comprising:

a first reservoir chamber;

a second reservoir chamber;

a first pipe member associated with the first reservoir chamber and having one end covered with a first filter;

a second pipe member associated with the second reservoir chamber and having one end covered with a second filter; and a spacer member having at least one conduit formed therethrough and located adjacent to only one of the first and second filters.

20. The cartridge of claim 19 wherein the first and second filters are located in planes that are substantially perpendicular to one another.

21. The cartridge of claim 19 further comprising a third reservoir chamber having a third pipe member associated therewith and having an end covered with a third filter, and a second spacer member having a conduit formed therethrough located adjacent to the third filter.

* * * * *

UNITED STATES PATENT AND TRADEMARK OFFICE

CERTIFICATE OF CORRECTION

PATENT NO. : 6,513,920 B1
DATED : February 4, 2003
INVENTOR(S) : Deshmukh et al.

It is certified that error appears in the above-identified patent and that said Letters Patent is hereby corrected as shown below:

Column 8,
Line 31, delete “die” and insert therefor -- the --.

Signed and Sealed this

Twenty-third Day of December, 2003

JAMES E. ROGAN
*Director of the United States Patent and Trademark Office*